United States Patent [19]

Araya et al.

[11] 4,368,032

[45] Jan. 11, 1983

[54] LIQUID FUEL COMBUSTION APPARATUS

[75] Inventors: Hiroyuki Araya, Fuji; Toshihiko Saito, Yokohama; Katsuyoshi Kumazawa, Yokohama; Moriyoshi Sakamoto, Yokohama; Mitoshi Koyama, Fuji, all of Japan

[73] Assignee: Tokyo Shibaura Denki Kabushiki Kaisha, Kawasaki, Japan

[21] Appl. No.: 165,036

[22] Filed: Jul. 1, 1980

[30] Foreign Application Priority Data

Jul. 6, 1979 [JP] Japan ..... 54-85561

[51] Int. Cl.[3] ..... F23D 5/04

[52] U.S. Cl. ..... 431/118; 431/261; 431/330; 431/338; 431/352

[58] Field of Search ..... 431/117, 118, 260, 261, 431/262, 330, 333, 338, 341, 352, 353; 432/222; 126/110 C, 110 D, 104 R, 104 A

[56] References Cited

U.S. PATENT DOCUMENTS

| | | | |
|---|---|---|---|
| 1,752,000 | 3/1930 | Horne | 431/117 |
| 2,194,081 | 3/1940 | Bock | 431/261 |
| 2,397,529 | 4/1946 | Breese | 431/333 |
| 2,409,677 | 10/1946 | Grotenhouse | 431/333 |
| 2,471,833 | 5/1949 | McCollum | 431/260 |
| 2,691,159 | 11/1952 | Young | 431/338 |
| 3,033,279 | 5/1962 | Huston | 431/262 |

FOREIGN PATENT DOCUMENTS

| | | | |
|---|---|---|---|
| 42-20366 | 8/1967 | Japan . | |
| 54-73333 | 6/1979 | Japan | 431/341 |
| 1005553 | 9/1965 | United Kingdom | 431/333 |

*Primary Examiner*—Samuel Scott
*Assistant Examiner*—Lee E. Barrett
*Attorney, Agent, or Firm*—Oblon, Fisher, Spivak, McClelland & Maier

[57] ABSTRACT

A liquid fuel combustion apparatus comprises a combustion cylinder, a fuel reservoir, a housing, a blower and an electrical ignition heater. The reservoir is disposed inside the cylinder to store a liquid fuel supplied from outside of the cylinder. The housing is disposed outside the cylinder to create a space therebetween and has an end wall opposite to an end wall of the cylinder. The blower is disposed outside, and in a spaced apart relation to, the housing and supply air to the space. The heater is supported by the end walls and ignite liquid fuel stored in the reservoir.

4 Claims, 4 Drawing Figures

LIQUID FUEL COMBUSTION APPARATUS

BACKGROUND OF THE INVENTION

This invention relates to a liquid fuel combustion apparatus and in particular to a liquid fuel combustion apparatus in which an air supply and discharge are forcedly effected.

Recently, various pot-type liquid fuel combustion apparatus of the forced air-supply/discharge variety have been developed. In these apparatus, an air supply means, such as blower, supply air for combustion into a fuel vapor after causing liquid fuel, such as kerosene, stored in a liquid reservoir to be heated by the ignition of an ignition heater to produce a fuel vapor. And a mixed gas which consists of the combustion air and the fuel vapor is burned in a blue flame.

A portion of the liquid fuel combustion apparatus includes a combustion cylinder having a circumferential wall with a number of air holes and an end wall by which one end of the combustion cylinder is blocked. The apparatus also have a housing arranged apart from the outer surface of the combustion cylinder to surround the outer surface of the combustion cylinder. The housing includes and end wall which is disposed opposite to the end wall of the combustion cylinder.

With the liquid fuel combustion apparatus, the air supply means for supplying the combustion air is fixed to the end wall of the housing to provide a rigid unit. The air supply means supplies the combustion air, through a small opening on the end wall of the housing, into a space between the inner surface of the housing and the outer surface of the combustion cylinder. For this reason, the ignition heater and the other communication component parts for permitting communication between an inside of the combustion cylinder and an outside of the housing have to be arranged on the circumferential wall of the combustion cylinder. It is necessary in such arrangement to form a plurality of openings for inserting the ignition heater and the other communication parts on the circumferential wall of the housing. The longer the circumferential length of the openings, the greater the difficulties encountered in sealing said openings. Since the opening for inserting the heater have the longest circumferential length, the seal member applied to the opening for the heater is naturally complicated. In the mounting of the seal member, a cumbersome operation is required. The openings must, after the ignition heater and the other communication component parts are inserted, be hermetically sealed by a seal member so that any combustion air may not leak out. Where the air supply means is constituted of a high static pressure type blower utilizing a turbofan, it is necessary to further enhance the extent of sealing of the sealing member with respect to the cutout and thus a structure of the seal member becomes complicated. The complexity of the structure of the seal member and the cumbersomeness of assembling result in a high cost of the combustion apparatus as a whole.

Since the air supply means is rigidly fixed to the housing such that it provides a rigid unit, the total axial length of the air supply means and housing becomes of necessity longer. Where the combustion apparatus is used in combination with another device, the manner in which it is combined with the other device is restricted, it being difficult to provide a compact structure.

SUMMARY OF THE INVENTION

It is accordingly the object of this invention to provide a liquid fuel combustion apparatus which permits a simpler structure and easier assembling of a seal member, requires no particular design consideration for the seal member even if an air supply means for producing high static pressure is used, and can provide a compact unit with a wider choice of design combination.

BRIEF DESCRIPTION OF THE DRAWINGS

This invention can be more fully understood from the following detailed description when taken in conjunction with the accompanying drawings, in which.

DETAILED DESCRIPTION OF THE PREFERRED EMBODIMENTS

Figure 1:
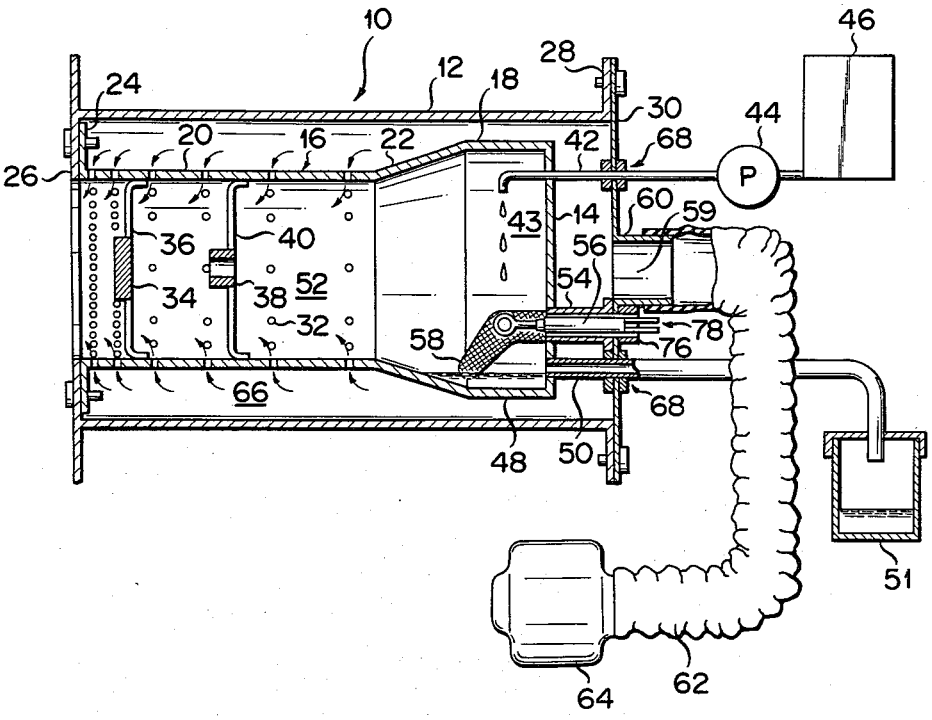
FIG. 1 is a cross-sectional view diagrammatically showing a liquid fuel combustion apparatus according to one embodiment of this invention.

FIG. 1 shows a liquid-fuel combustion apparatus 10 according to one embodiment of this invention. The apparatus 10 includes a cylindrical housing 12 which is horizontally arranged in the longitudinal direction. A combustion cylinder 16 having its one end closed by an end wall 14 is arranged in a coaxially, spaced-apart relation within the housing 12. In this embodiment, the end wall 14 of the housing 12 is formed of a flat plate. The combustion cylinder 16 comprises a first circumferential wall portion 18 located near the end wall 14, a second circumferential wall portion 20 extending from an open end (i.e. the other end) thereof toward the middle portion thereof and having a smaller diameter than that of the first circumferential wall portion 20, and a third circumferential wall portion 22 having a tapered shape and merging with the first and second circumferential wall portions. The combustion cylinder 16 as a whole has a length shorter than that of the housing 12. A first flange 24 is outwardly projected on the outer marginal surface of the open end of the combustion cylinder 16. The outer diameter of the first outer flange 24 is made smaller than the inner diameter of the housing 12. The first outer flange 24 is contacted with the inner surface of an inner flange 26 inwardly projected at one end of the housing 12 and secured there by bolts. A second outer flange 28 is projected on the outer marginal surface of the other end of the housing 12. An end wall 30 formed of a flat plate is secured by bolts to the outer surface of the second outer flange 28. The end wall 30 is disposed parallel to the end wall 14 of the combustion cylinder 16.

A number of air holes 32 are bored in multi-stages over the length of the second circumferential wall portion 20 of the combustion cylinder 16 and the air holes in each stage are arranged at an equal pitch in the circumferential direction of the second circumferential wall portion 20 of the combustion cylinder 16. A first flame stabilizing baffle 34 having a disc like shape is disposed near the open end of the combustion cylinder 16 and concentrically within the second circumferential wall portion 20 of the combustion cylinder 16 and has an outer diameter smaller than the inner diameter of the second circumferential wall portion 20. The first stabilizing baffle 34 is fixed to the second circumferential wall portion 20 by a plurality of radially projecting support bars 36. A second flame stabilizing baffle 38 having a hollow disc like shape is disposed within and concentrical with the second circumferential wall portion 20 of the combustion cylinder 16 such that it is located midway between the fixed position of the first flame stabilizing baffle 34 and a position of an intersection with the third circumferential wall portion 22. The second flame stabilizing baffle 38 has an outer diameter smaller than the inner diameter of the second circumferential wall portion. The second flame stabilizing baffle 38 is secured, like the first flame stabilizing baffle, to the second circumferential wall portion 20 by a plurality of support bars 40.

A fuel supply pipe 42 is inserted through the upper portion of the end wall 14 of the combustion cylinder 16 such that it extends in a direction substantially transverse to the end wall 14. The fuel supply pipe 42 is supportingly fixed in a water-tight fashion to the end wall 14 by a conventional means such as welding. One end of the fuel supply pipe 42 extends toward the interior (hereinafter referred to as a fuel evaporation region 43) of the first and third circumferential wall portion. The other end of the fuel supply pipe 42 is inserted out through the end wall 30 of the housing 12 such that it extends in a direction transverse to the end wall 30. The other end of the fuel supply pipe 42 further extends through a fuel pump 44 into a fuel tank 46 where is connected. The fuel supply pipe 42 permits liquid fuel stored in the fuel tank 46 to be supplied drop by drop into the fuel evaporation region 43. In this case, an amount of liquid fuel supply is varied by varying an amount of discharge from the fuel pump 44.

A fuel reservoir 48 is located at the lowest portion of the fuel evaporation region 43 such that it is defined by the lower inner surfaces of the first and third circumferential wall portion 18 and 22 and lower inner surface of the end wall 14. The liquid fuel so supplied is stored in the fuel reservoir 48.

An overflow tube 50 extends through the lower portion of the end wall 14 in a manner to be substantially perpendicular to the end wall 14, and fixed in a water-tight fashion to the end wall 14 by a conventional means such as welding etc. One end of the overflow tube 50 is made flush with the inner surface of the end wall 14. The inserting position of the overflow tube 50 is located at a level lower than an intersection of the second and third circumferential wall portion 20 and 22. The other end of the overflow tube 50 extends out through the end wall 30 in a manner to be perpendicular to the end wall 30 of the housing 12, and is connected to the top of a discharge oil tank 51. Since the mount of the liquid fuel once stored in the fuel reservoir 48 is regulated by the overflow tube 50 to a predetermined level, no liquid fuel flows into the interior (hereinafter referred to as a combustion region 52 of the second circumferential wall portion of the combustion cylinder 16).

An ignition means attaching tube 54 extends through the end wall 14 in a manner to be perpendicular to the end wall 14 and is located in a position higher than the fixed position of the overflow tube 50. The attaching tube 54 is supportingly fixed, in a water-tight fashion, to the end wall 14 by a conventional means such as welding. One end of the attaching tube 54 is made flush with the inner surface of the end wall 14 and a packing is fixed to the other end of the attaching tube 54. The attaching tube 54 is attached to the inner surface of the end wall 30 of the housing 12 with the packing in between. A hole is formed in a location where the other end of the attaching tube 54 is contacted with the end wall 14 and has a diameter equal to the inner diameter of the attaching tube 54. An ignition means 56 is constituted of a bar-like, electrical ignition heater and inserted through said hole into the attaching tube 54. One end of the ignition means 56 which constitutes a ignition portion is located above the fuel reservoir 48. The heater of the ignition means 56 is covered by a fuel absorption net 58 which is fixed to the end wall 14. When current is supplied to the ignition means 56 the liquid fuel drawn by the net 58 from the fuel reservoir 48 is heated and lighted. An opening 59 is formed at the central portion of the end wall 30 of the housing 12. An air conduction tube 60 for combustion is fitted on the edge of the front surface of the end wall 30 which regulates the opening 59 and extends outwardly. A bellows tube 62 is connected at one end to the air conduction tube 60 and at the other end to an air supply means 64 such as a blower. The air supply means 64 supplies a predetermined amount of combustion air to a space 66 (i.e. a space of applying pressure to the combustion air) defined by the inner surfaces of the housing 12 and end wall 30 and the outer surface of the combustion cylinder 16. An air pressure in the space 66 is once raised there and jetted at high spreads into the combustion region 52 through the air holes 32, creating an air stream toward the open end of the combustion cylinder.

Figure 2:
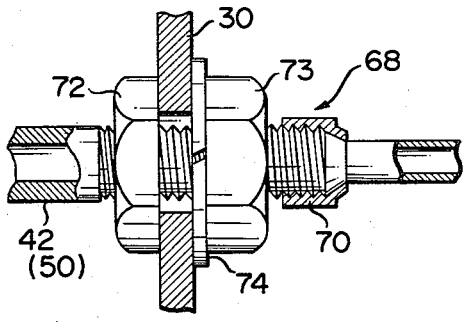
FIG. 2 is an enlarged, cross-sectional view showing a first seal member of the apparatus of FIG. 1.

The mounting portions of the fuel supply tube 42 and overflow tube 50 with respect to the end wall 30 are supported by a first seal member 68 in a water-tight fashion, the first seal member 68 constituting one constituent element of a joint as shown in detail in FIG. 2. A combustion air supplied to the pressure applying space 66 does not leak into the outer atmosphere through the above-mentioned mounting portions. The first seal member 68 comprises a pair of nuts 72, 73 threaded over an external thread 70 formed on the outer surface of the fuel supply tube 42 or the overflow tube 50 and a spring washer 74 disposed between the end wall 30 and an external one (one nut 73 in this case) of the nuts 72, 73. The pair of nuts 72, 73 clampingly hold the end wall 30 there between such that the spring washer 74 is placed between the end wall 30 and the washer 73. An ignition means insertion hole on the end wall 30 is hermetically sealed by a cover 76 which is fixed to the outer surface of the end wall 30. As a result, the liquid fuel is prevented from leaking from the fuel evaporation region 43 through the abovementioned hole into the outer atmosphere. The cover 76 is in contact with the packing fixed to the other end of the ignition means attaching tube 54, providing a second seal member 78 for the ignition means 56. Therefore, there is no risk that the combustion air supplied to the space 66 will not leak out through the ignition means insertion hole.

With the liquid fuel combustion apparatus so constructed, when the air supply means 64 and ignition means 56 are operated substantially simultaneously, a predetermined air stream is created toward the combustion region 52 in the combustion cylinder 16 and thus toward the open end of the combustion cylinder 16 and at the same time the ignition portion of the ignition means 56 is heated. With the fuel pump 44 operated, liquid fuel is supplied from the fuel tank 46 to the fuel reservoir 48 in the fuel evaporation region 43. When the liquid fuel reaches a certain level, in the fuel reservoir 48, it is drawn by the fuel absorption net 58 and burned by the ignition means 56. By the fire flame the liquid fuel held in the fuel reservoir 48 is gasified and the flame is propagated to the fuel vapor and spread within the fuel evaporation region.

When the temperature of an atmosphere in the fuel evaporation region 43 is raised, the liquid fuel supplied dropwise from the fuel supply pipe 42 is gasified before reaching the fuel reservoir 48, and becomes a fuel vapor.

At this time, at the start of burning, the temperature of the liquid fuel stored in the fuel reservoir is relatively low and thus an amount of evaporation of liquid fuel is small compared with an amount of supply of the liquid fuel. Where the amount of supply of the liquid fuel is greater than that of evaporation of liquid fuel, the liquid fuel is reached near the level of the overflow tube 50 until the amount of evaporation of liquid fuel becomes great compared with the amount of supply of liquid fuel, a situation after the temperature of an atmosphere in the fuel evaporation region 43 is raised a certain time after ignition. Even if the amount of supply of the liquid fuel is normally relatively great, the liquid fuel in the fuel reservoir 48 rarely reaches the level of the overflow tube 50. Where the time taken from the start of fuel supply until the ratio between the amount of supply and the amount of evaporation is reversed is greater than a normal time due to some reason or others such as the ignition time delay, that excess portion of the liquid fuel supplied to the fuel reservoir is collected into the discharge oil tank 51 through the overflow tube 50. Since, therefore, the liquid fuel is not flowed into the combustion region 52, it is possible to prevent fire accident due to abnormal burning. Now suppose that the amount of supply of the liquid fuel is relatively small or medium. Since in this case the time taken from the start of the fuel supply until the ratio between the amount of supply of the liquid fuel and the amount of evaporation of the liquid fuel is reversed becomes correspondingly small, there is rarely a chance that the overflow tube 50 will be required.

The liquid vapor in the fuel evaporation region 43 is once rolled, near the second circumferential wall portion 20, in an air stream jetted at rapid speeds from each air hole 32 of the second circumferential wall portion 20 of the combustion cylinder. The liquid vapor, after being beforehand mixed with the air stream, the above-mentioned flame in the fuel evaporation region 43 is propagated and burned in a blue flame. Within the combustion region 52, radial blue flames directed toward the axis of the combustion cylinder 16 are formed at the multi-stages in the axial direction of the combustion cylinder. It the same time, an unburned fuel vapor is carried by the air stream toward the open end of the combustion cylinder 16. The unburned fuel vapor promotes its mixing with the air by an eddy current of air created near the first and second flame stabilizing baffles 34, 38 and is ignited by the blue flame and burned. Since the blue flame and the flame resulting from the burning of the unburned fuel vapor have their axial direction restricted by the first and second flame stabilizing baffles 34, 38, they are prevented from being flowen out from the open end of the combustion cylinder 16. The first and second flame stabilizing baffles 34, 38 promote through the eddy current a secondary oxidation process of the exhausted poisonous materials, such as hydrocarbon or carbon monoxide, which are produced at the burning time. As a result, the exhausted gas can be cleaned out.

As set out above, since the liquid fuel combustion apparatus of this invention supports the ignition means between the end wall of the combustion cylinder and the end wall of the housing, it is possible to provide a simple shaped opening for the ignition means. It is also possible to make simpler the structure and mounting of a seal member for sealing off the opening. Where use is made of a high static pressure air supply means, no particular design consideration is necessary. As the air supply means is provided outside the housing such that it is spaced apart from the housing, it is possible to make the axial length of the housing shorter. According to this invention it is possible to combine the combustion apparatus with the other device freely and in a compact way. Since the air supply means is connected by the bellows tube to the pressure applying space the arrangement of the air supply means with respect to the combustion apparatus can be effected freely with a wide design choice.

With the embodiment of this invention the fuel reservoir is constituted of a space which is defined by the end wall of the combustion cylinder and first and third circumferential wall portion, permitting an easier manufacture and assembly of the combustion cylinder including the fuel reservoir. As the third circumferential wall portion of the combustion cylinder portion is gradually tapered from the first circumferential wall portion toward the second circumferential wall portion, a combustion air stream between the fuel evaporation region 43 and the combustion region 52 can be adjusted, thereby enhancing a combustion efficiency.

Figure 3:
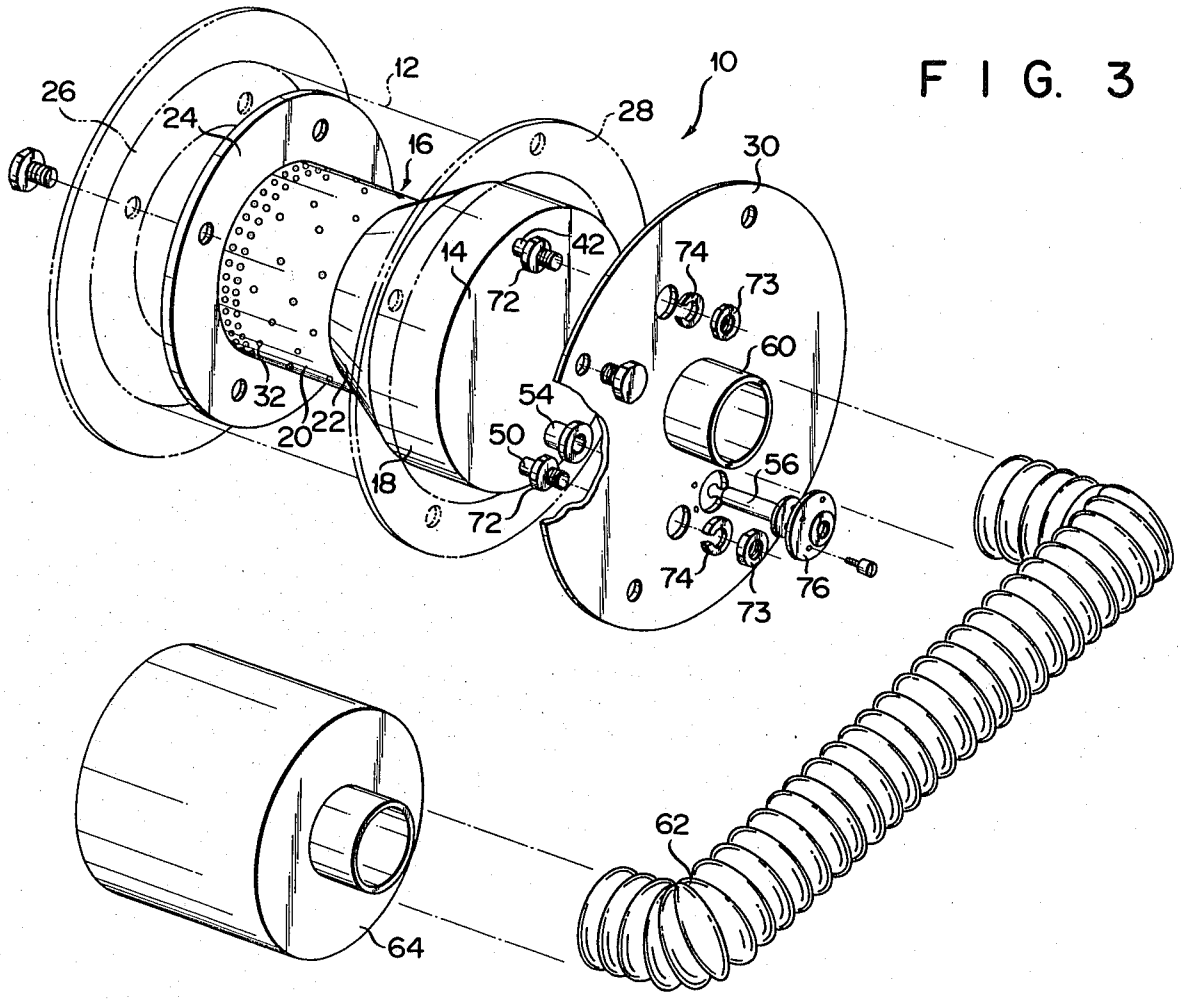
FIG. 3 is an exploded, perspective view, partly omitted, showing the apparatus of FIG. 1.

As shown in FIG. 3 the end wall 14 of the combustion cylinder 16 is formed of a flat plate, and the fuel supply tube 42, overflow tube 50 and ignition means attaching tube 54 are substantially vertically fixed to the end wall 14. At the assembly time of the liquid fuel combustion apparatus 10 the three tubes 42, 50 and 54 are perpendicularly inserted into the end wall 30, which is arranged parallel to the end wall of the housing 12, permitting a simpler structure and easy mounting of the first and second seal members 68, 78. The end wall 30 is readily attached and detached to and from the housing 12 to permit ready inspection and repairs of the liquid fuel combustion apparatus 10. The combustion cylinder 16 has its outer flange 24 axially contacted with, and fixed by bolts to, the inner flange 26 of the housing 12. As a result, it is possible to readly assemble the liquid fuel combustion apparatus as a whole.

Although this invention is described in connection with the above-mentioned embodiment, it is not restricted thereto.

Figure 4:
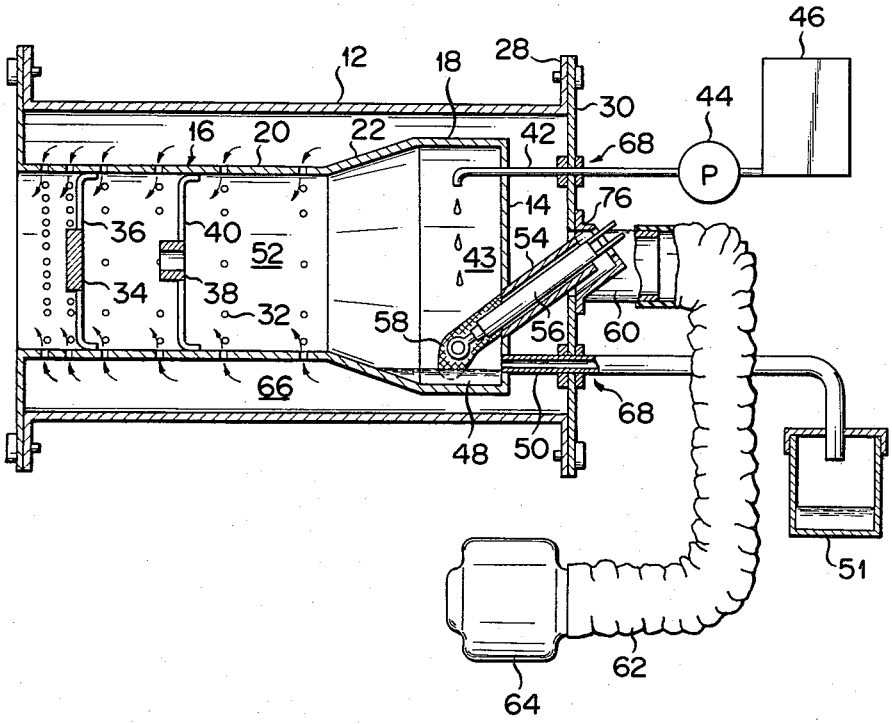
FIG. 4 is a cross-sectional view diagrammatically showing a modified form of liquid fuel combustion apparatus. The embodiment of this invention will be explained below by referring to the accompanying drawings.

As shown in FIG. 4, for example, an ignition means attaching tube 54 is fixed to an end wall 14 of a combustion cylinder 16 in a manner to be inclined with respect to the end wall 14 of the combustion cylinder 16 and an end wall 30 of a housing 12. The end wall 14 of the combustion cylinder 16 may be formed of a plate with a small curvature. The end wall 30 of the housing 12 has not to be arranged parallel to the end wall 14 of the combustion cylinder 16 and may be formed of a plate with a small curvature.

In place of a fuel reservoir 48 defined by the lower inner surfaces of the first and third circumferential wall portion 18, 22 and the lower inner surface of the end plate 14 a separate box may be placed within the combustion cylinder 16 so that a liquid fuel may be supplied dropwise from a fuel supply tube 42 to the box.

The first and second seal members 68, 78 for the fuel supply tube 42, overflow tube 50 and ignition device attaching tube 54 are not restricted to those as described in connection with the embodiment and may be changed in a variety of ways.

What we claim is:

1. A liquid fuel combustion apparatus comprising:

a combustion cylinder having a first cylindrical wall portion, a second cylindrical wall portion which has a diameter smaller than that of said first cylindrical wall portion and arranged coaxially with said first cylindrical wall portion, a connecting wall portion which is arranged coaxially with said first and second cylindrical wall portions and is connected to said first and second cylindrical wall portion, and an end wall which has a flat plate like shape, intersects with the longitudinal axis of said first cylindrical wall portion at a substantially right angle and blocks one end of said first cylindrical wall portion opposite said connecting wall portion;

a fuel reservoir defined by the lower portions of said end wall, said first cylindrical wall portion and said connecting wall portion;

a housing disposed outside of said combustion cylinder, said housing being arranged coaxially with said combustion cylinder in a spaced-apart relation to said combustion cylinder to create a space therebetween, said housing including an end wall which is fixed to said housing, said end wall of said housing having a flat plate like shape, and being arranged parallel with said end wall of said combustion cylinder, so as to face each other;

air supply means disposed outside of said housing and having a flexible duct which is connected to said end wall of said housing so as to supply air into said space located between said housing and said combustion cylinder;

air passage means in said second cylindrical wall portion to supply air from said space between said housing and said combustion cylinder to said combustion cylinder;

a liquid fuel supply pipe supported by said end walls of said housing and combustion cylinder so as to supply liquid fuel to said fuel reservoir;

an overflow pipe supported by said end walls of said housing and combustion cylinder so as to discharge, toward the outside of said housing, a fuel portion exceeding a predetermined amount of liquid fuel which is supplied into said fuel reservoir;

ignition means supported by said end walls of said housing and combustion cylinder so as to ignite the liquid fuel stored in said fuel reservoir.

2. The liquid fuel combustion apparatus according to claim 1 in which said liquid fuel supply pipe, said overflow pipe and said ignition means make a substantially right angle to said end walls of said housing and combustion cylinder.

3. The liquid fuel combustion apparatus according to claim 1 in which said ignition means is supported by said end walls of said housing and said combustion cylinder in an inclined state with respect to said end walls.

4. The liquid fuel combustion apparatus according to claim 1 in which said connecting wall portion is gradually tapered from said first cylindrical wall portion toward said second cylindrical wall portion.

* * * * *